United States Patent [19]

Richards

[11] Patent Number: 4,462,243

[45] Date of Patent: Jul. 31, 1984

[54] TOOL SUPPORT FOR MACHINES

[75] Inventor: Robert E. Richards, Kalamazoo, Mich.

[73] Assignee: J. A. Richards Company, Kalamazoo, Mich.

[21] Appl. No.: 419,978

[22] Filed: Sep. 20, 1982

[51] Int. Cl.[3] ..... B21D 37/04

[52] U.S. Cl. ..... 72/481; 72/389

[58] Field of Search ..... 72/389, 386, 384, 383, 72/481, 293, 316, 318; 144/306, 307, 308, 287; 409/903; 269/47, 52, 93, 91, 99, 900; 248/222.4

[56] References Cited

U.S. PATENT DOCUMENTS

| | | | |
|---|---|---|---|
| 1,382,400 | 6/1921 | Ross | 269/93 |
| 2,406,182 | 8/1946 | Zeitz | 72/383 |
| 2,661,783 | 12/1953 | Caston | 269/91 |
| 3,918,286 | 11/1975 | Whitehead | 72/389 |

FOREIGN PATENT DOCUMENTS 797732 7/1958 United Kingdom .

*Primary Examiner*—Francis S. Husar
*Assistant Examiner*—Linda McLaughlin
*Attorney, Agent, or Firm*—Price, Heneveld

[57] ABSTRACT

A tool holder bracket is provided having a pair of parallel legs connected by a web which offsets the legs. One leg of the tool holder has a pair of anchor pins with enlarged heads for securing the bracket to a work support platform by inserting the anchor pins through keyhole-shaped openings and locking the bracket to the platform by engaging the heads under the platform. A pin is inserted through the other leg of the tool holder and an aligned opening in the platform to attach a tool to the bracket between the leg and the platform surface.

6 Claims, 6 Drawing Figures

TOOL SUPPORT FOR MACHINES

FIELD OF THE INVENTION

This invention relates to machine tools and more particularly to a work or pivot block holder for such a tool.

BACKGROUND OF THE INVENTION

In many machine tools, particularly those which involve bending, cutting or forming, it is necessary to provide means for holding the workpiece, or at least portions of the workpiece, stationary with respect to the active or moving element of the tool. For this purpose various types of workpiece supports or holders are secured to work supports or platforms. The position of these work holders, both with respect to each other and to the active element of the tool, have to be adjusted from time to time. This adjustment normally involves a disassembly operation followed by a reassembling of the work holder to the platform. This is a time consuming operation. It is also of the utmost importance that these work holders or pivot block holders, as they may be referred to, be secured to the work platform in such a manner that there is no danger of inadvertent disconnection which would not only be dangerous to personnel but would also, in all probability, render the workpiece scrap. To assure accuracy of the tool, it is necessary that these work holders accurately maintain their position without twisting, bending or shifting in any way. To satisfy the strength, rigidity and safety aspects of these devices, the work holders have been massive in construction and have been attached in a manner such that substantial time and effort has been necessary to attach and detach them from the platform. In general, they have been cumbersome and time consuming whenever it is necessary to change tooling.

BRIEF DESCRIPTION OF THE INVENTION

The invention provides a Z-shaped bracket having a pair of pins with enlarged heads designed to seat in and engage a pair of keyhole-shaped slots in the work platform. One portion of the bracket is spaced from the surface of the work platform to receive the workpiece engaging tool such as a pivot block. The pivot block is secured by a pin which extends through the bracket, the pivot block and an aligned opening in the work platform. The enlarged heads on the pins positively lock the tool to the platform so that pressures exerted on the bracket cannot cause any lifting action. With a large number of spaced openings provided in the work platform, the tool is made readily and quickly movable from one work position to another.

DESCRIPTION OF THE PREFERRED EMBODIMENT

Figure 1:
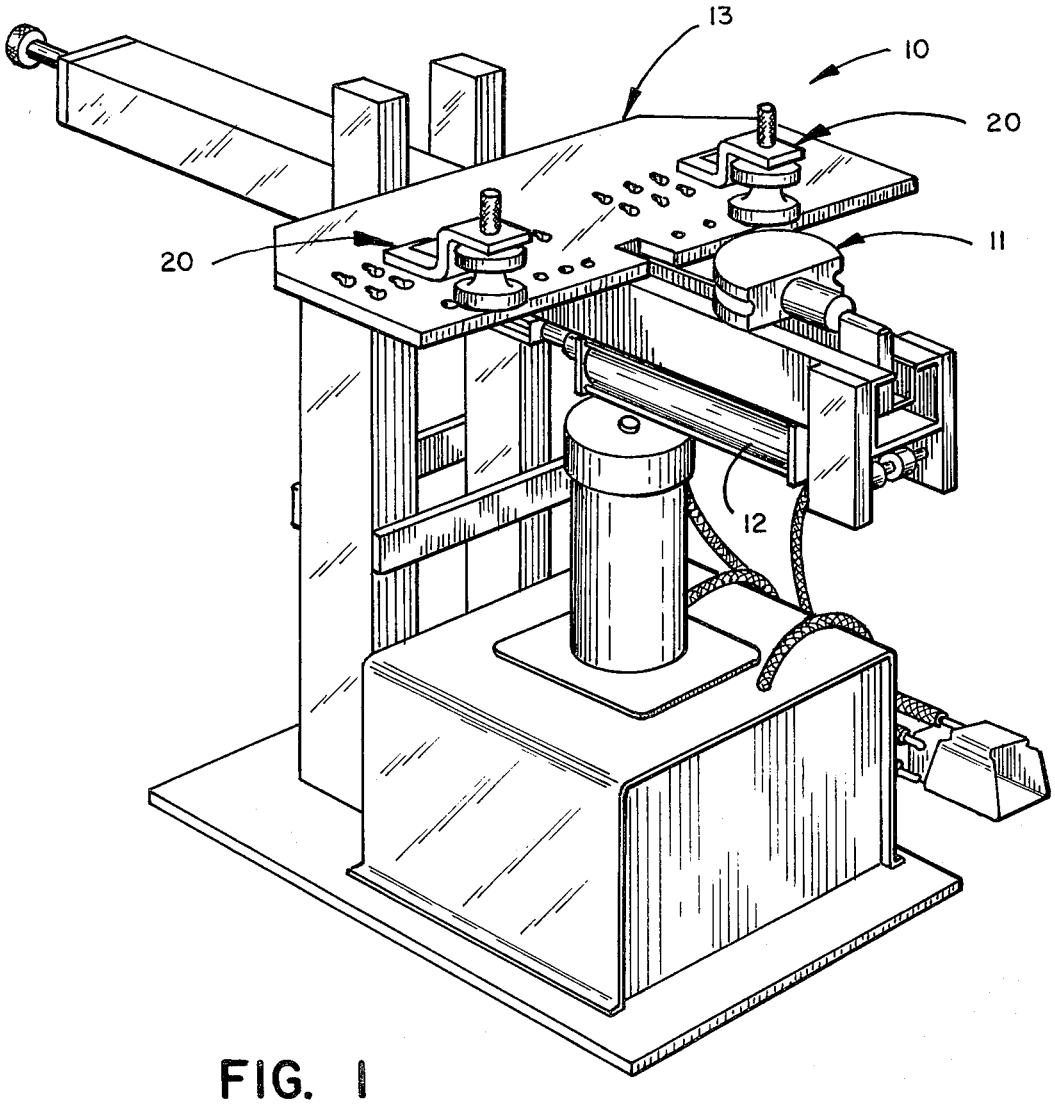
FIG. 1 is an oblique view of a machine with which this invention can be utilized.
Figure 2:
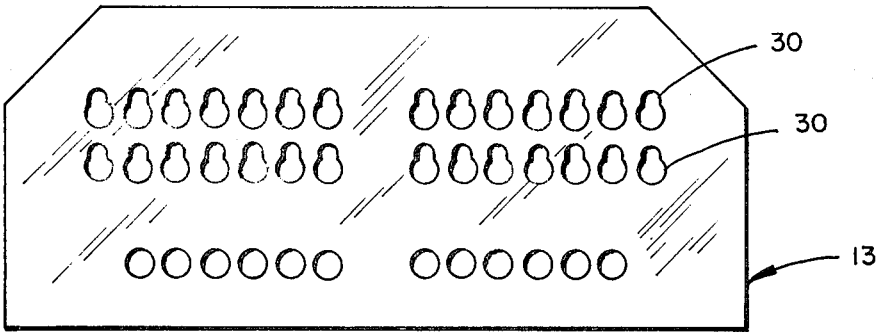
FIG. 2 is a plan view of a work platform designed for use with this invention.
Figure 3:
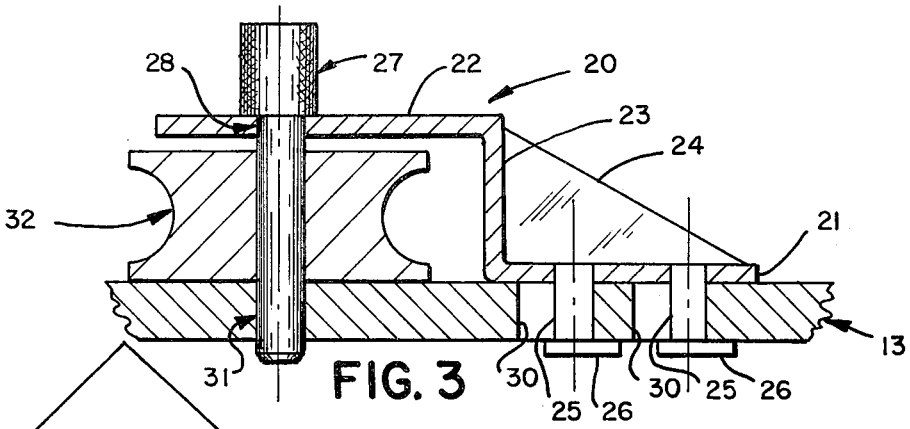
FIG. 3 is a fragmentary, central sectional view of a work holder bracket incorporating this invention.

The numeral 10 refers to a bending machine having a fluid actuated ram 11 which is reciprocated by the cylinder 12 to shape workpieces seated on the work platform 13. The tool 10 is the subject of my co-pending application entitled "Multi Position Article Bender", Ser. No. 419,977, filed Sept. 20, 1982, and assigned to a common assignee and the disclosure in that application is incorporated herein by reference.

Mounted on the work platform are a pair of work holder brackets 20. For purposes of illustration the invention will be described as used for mounting pivot blocks. However, it is to be understood that such is illustrative only since various other types of work holders could be substituted. The brackets are illustrated as spaced to cooperate with the ram 11. Each bracket 20 has a Z-shaped body having one leg 21 designed to seat against the surface of the platform 13 and a second leg 22 parallel with the leg 21 but offset to space it from the surface of the platform 13. The legs 21 and 22 are connected by the vertical web 23. The bracket is cast or otherwise formed from steel of a thickness such that it is a rigid structure capable of sustaining severe loading. The web 23 is further supported by a brace 24 welded to both the web and the leg 21. The lower surface of the leg 21 is machined or otherwise provided with a flat lower surface so that it can seat firmly and uniformly on the surface of the platform 13.

Secured to the leg 21 and depending from it are a pair of pins 25 each of which is equipped with an enlarged head 26. While the pins could be welded to the surface of the leg 21, they preferably extend through the leg and are welded to the leg at their upper ends. The pins 25 are spaced apart lengthwise of the bracket with a spacing that accurately coordinates with the spacing between the holes 30 in the work platform 13 which are arranged in pairs centered on an axis parallel with the stroke of the ram 11. The end of each opening 30 closest to the ram 11 is enlarged sufficiently to allow the heads 26 of the pins 25 to pass through it. The opposite end of the holes 30 is of a size to slidably receive the shank of one of the pins 25 with a close fit.

Figure 4:
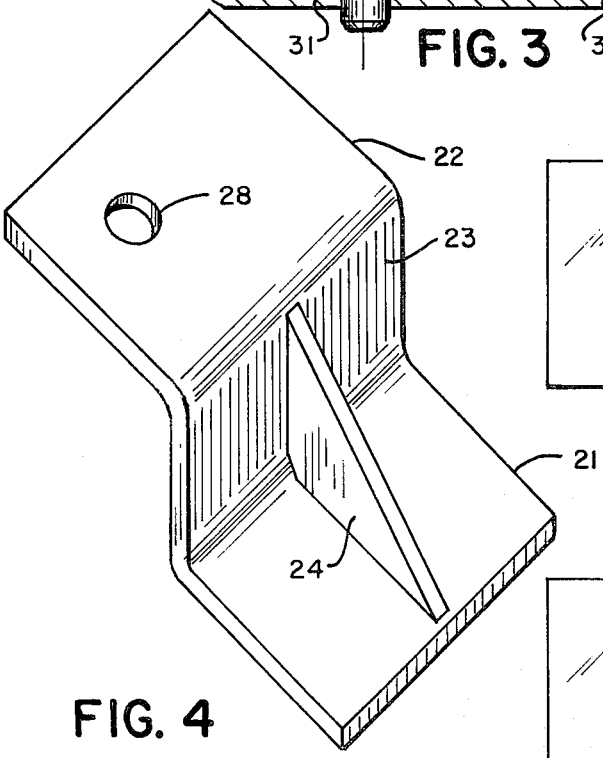
FIG. 4 is an oblique view of one of the work holder brackets.
Figure 5:
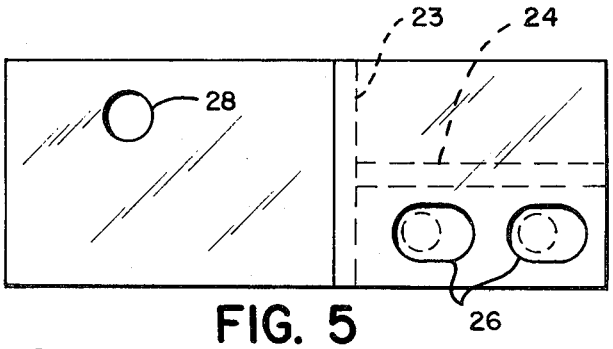
FIG. 5 is a bottom view of the work holder bracket illustrated in FIG. 3.

Aligned with the holes on the same axis and spaced from the holes 30 toward the ram 11 is an opening 31 for a tool anchor pin 27 which is installed through an aligned opening 28 in the leg 22 of the bracket. The anchor pin is designed to mount the work engaging element such as the pivot block 32. It will be noted from FIGS. 4, 5 and 6 that the opening 28 is offset to one side of the centerline of the bracket. It is also offset on the opposite side of the centerline from the pins 25. This permits the brackets 20 to be so located that the pivot blocks can be quite close together when such is desired. It will also be noted that this results in one additional pair of keyhole openings 30 with respect to pin openings 31 adjacent each end of the platform 13. Because the loads applied to the pivot block or other tools secured by the pin 27 are directly transmitted by the pin 27 to the work platform and are also absorbed by both pins 25 which seat snuggly within their openings, the workpiece support is positively and firmly held against any form of twisting or movement. While the offset arrangement of the opening 28 from the pins 25 produces a torsional loading about the pins 25, this load is largely absorbed in shear by the pin 27 seated in the opening 28. The arrangement also helps to cancel out forces which might otherwise have a tendency to lift the bracket and tool from the surface of the platform. Since the loads imposed on the work bracket when the tool is being operated are always in a direction away from the ram 11, the loads always tend to drive the pins 25 further into the narrow ends of the slots 30, positively locking the bracket from inadvertent release from the platform.

It will be observed that the positioning of the tools on each side of the ram, or whatever other tool is to be used, can be quickly and easily adjusted simply by sliding the brackets forwardly or toward the ram sufficiently to align the heads 26 with the larger ends of the openings 30, permitting the pins to be withdrawn. Installation at the new location is just as simple, with the bracket being attached simply by engaging the pins in another pair of holes 30 at a new location. The pivot block is then aligned with the openings 28 and 31 and the pin 27 installed.

The invention provides a positive support for pivot blocks and other tools. It also provides a quick, simple and effective tool support which permits rapid relocation of the tool. This reduces down time and labor costs as well as increasing the versatility of the tool.

Figure 6:
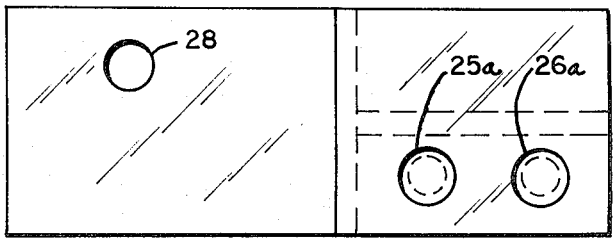
FIG. 6 is a bottom view of a modified work holder bracket.

FIG. 6 illustrates a modification in which the heads 26*a* of the pins 25*a* are enlarged and concentric with the shank of the pin. This does not in any way change the basic concept of the tool. It merely provides an arrangement which permits the enlarged end of the openings 30 to be somewhat smaller and circular and, therefore, somewhat easier to fabricate.

While the invention has been described as used with a horizontal work surface, it can be used with an inclined or vertical work surface. The only limitation is that the surface be so arranged that the narrow ends of the openings 30 be positioned toward the lower edge of the platform. When so positioned a bar can be placed between the brackets to support appropriate tools to utilize the machine as an arbor press or a small press brake, or without such a bar as a vertical straightening press.

Having described the preferred embodiment of the invention, it will be understood that modifications of the invention can be made without departing from the principles thereof. Such modifications are to be considered as included in the hereinafter appended claims unless these claims by their language expressly state otherwise.

The embodiments of the invention in which an exclusive property or privilege is claimed are defined as follows:

1. Means for adjustably supporting tools on a machine tool having a tool supporting platform, said platform having a flat work surface and means for applying a working force in one direction parallel to said surface, said supporting means including: said platform having a plurality of openings therein, said openings being elongated in the plane of the platform and having interconnected narrow and wide portions at opposite ends, said openings being arranged in pairs with the openings of each pair spaced apart and aligned along their greater axes; a tool holder bracket having oppositely extending upper and lower legs and a generally vertical web interconnecting said legs; said legs being parallel to each other and the surface of said platform; a pair of anchor members depending from the lower face of of each said lower legs, said members each having a shank portion and an enlarged head at the free end of the shank, said head being of a size to pass through the larger portion of one of the openings but not the smaller portion, said shank being of a size to seat in the narrower portion of the same opening; said shank being of a length equal to the axial length of openings; a pin aperture in said upper leg; said platform having a plurality of holes therein, one of said holes being aligned with said pin aperture when said tool holder is secured to said platform.

2. Means for adjustably securing tools as described in claim 1 wherein a tool engaging pin extends through the pin aperture and the aligned hole.

3. Means for adjustably securing tools as described in claim 1 wherein said pin aperture is offset to one side of the longitudinal centerline of said tool holder bracket.

4. Means for adjustably securing tools as described in claim 1 wherein a brace element is rigidly secured to the upper face of said lower leg and the outer face of said vertical web, said brace element being substantially centered between the sides of said tool holder.

5. Means for adjustably supporting tools on a machine tool having a tool supporting platform, said platform having a flat work surface, lineally movable means for applying a working force in one direction parallel to said surface, said supporting means including: said platform having a plurality of openings therein, said openings being elongated in the plane of the platform and parallel to the direction of movement of said movable means and each having an interconnected and aligned narrow portion at one end and a wide portion at the other end, said openings being arranged in pairs with the openings of each pair spaced apart and aligned along their greater axes; a generally Z-shaped tool holder bracket having oppositely extending upper and lower legs and a generally vertical web interconnecting said legs; said legs being parallel to each other and the surface of said platform; a pair of anchor members depending from the lower face of said lower leg, said members each having a shank portion and an enlarged head at the free end of the shank, said head being of a size to pass through the larger portion of one of the openings but not the smaller portion, said shank being of a size to seat in the narrower portion of the same opening; said shank being of a length equal to the axial length of said openings whereby said bracket can be secured to said platform by passing said heads through the wide portions of a pair of said openings and moving said bracket to seat said shanks in the narrow portions of said openings with the heads engaging the lower surface of said platform.

6. Means for adjustably securing tools as described in claim 5 wherein a pin aperture is provided in said upper leg; said platform having a plurality of holes therein, each hole being aligned with one of said pairs of openings; one of said holes being aligned with said pin aperture when said tool holder is secured to said platform.

* * * * *